US007213898B2

(12) United States Patent
Hara

(10) Patent No.: US 7,213,898 B2
(45) Date of Patent: May 8, 2007

(54) COLOR INK-JET PRINTER

(75) Inventor: Koichiro Hara, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 173 days.

(21) Appl. No.: 10/696,436

(22) Filed: Oct. 29, 2003

(65) Prior Publication Data

US 2004/0246288 A1 Dec. 9, 2004

(30) Foreign Application Priority Data

Oct. 30, 2002 (JP) ..... 2002-315200

(51) Int. Cl.
*B41J 2/205* (2006.01)

(52) U.S. Cl. ..... 347/15; 347/43

(58) Field of Classification Search ..... 347/40, 347/43, 15, 9–11, 57
See application file for complete search history.

(56) References Cited

U.S. PATENT DOCUMENTS

| | | | | |
|---|---|---|---|---|
| 5,790,152 | A * | 8/1998 | Harrington | 347/48 |
| 5,798,776 | A * | 8/1998 | Uchiyama et al. | 347/43 |
| 5,880,758 | A * | 3/1999 | Stoffel et al. | 347/43 |
| 5,900,891 | A * | 5/1999 | Shimoda | 347/43 |
| 5,923,345 | A * | 7/1999 | Imai | 347/11 |
| 6,169,556 | B1 | 1/2001 | Koitabashi et al. | |
| 6,186,615 | B1 * | 2/2001 | Sato et al. | 347/43 |
| 6,290,329 | B1 * | 9/2001 | Terasawa et al. | 347/43 |
| 6,416,149 | B2 | 7/2002 | Takahashi | |
| 6,416,150 | B1 | 7/2002 | Kimura | |
| 6,776,468 | B2 * | 8/2004 | Miller et al. | 347/9 |

FOREIGN PATENT DOCUMENTS

| | | |
|---|---|---|
| JP | 4364961 | 12/1992 |
| JP | A-10-16225 | 1/1998 |
| JP | A-2000-85119 | 3/2000 |

* cited by examiner

*Primary Examiner*—Thinh Nguyen
(74) *Attorney, Agent, or Firm*—Reed Smith LLP

(57) ABSTRACT

A color ink-jet printer including a black-ink ejecting portion operable to eject droplets of a black ink, an other-color-ink ejecting portion operable to eject droplets of one of yellow, magenta and cyan inks, a first control portion operable to control the black-ink ejecting portion such that a total volume of at least one droplet of the black ink which forms each black ink dot is equal to a selected one of a plurality of different total volume values, and a second control portion operable to control the other-color-ink ejecting portion such that a total volume of at least one droplet of the ink of a color other than black, which forms each dot of that color, is equal to another of the different total volume values which is smaller than the value selected for the black ink. The first and second control portions are operable to select the respective different total volume values according to a presently selected print mode, or a gray-scale value at each picture element of an image to be printed.

33 Claims, 7 Drawing Sheets

COLOR INK-JET PRINTER

The present application is based on Japanese Patent Application No. 2002-043800 filed Oct. 30, 2002, the contents of which are incorporated herein by reference.

BACKGROUND OF THE INVENTION

1. Field of the Invention

The present invention relates to a color ink-jet printer capable of ejecting ink droplets of different colors.

2. Discussion of Related Art

U.S. Pat. No. 6,416,149 B2 (in particular, FIGS. 4–6, and col. 1, lines 46–53 and col. 5, lines 43–50) corresponding to JP-2001-301206A discloses an ink-jet printer operable such that at least one droplet of an ink each having a predetermined volume is ejected from each nozzle, so as to form a dot of ink on a recording medium in the form of a paper sheet, such that where a plurality of ink droplets are ejected from the nozzle, the ink droplets overlap each other so as to form one ink dot. Thus, a desired gray-scale value can be established at each picture element of an image corresponding to each ink dot to be formed on the paper sheet according to image data (printing data), by suitably selecting one of three different total volume values (large, medium and small values) of the above-indicated at least one ink droplet, for each of the ink dots, so that each ink dot has the corresponding one of three different sizes or diameters which are determined by the respective three different total volume values.

Publication JP-4-364961A of Japanese Patent Application (in particular, paragraphs [0020] and [0021]) discloses a color ink-jet printer capable of ejecting droplets of inks of different colors which have different compositions so that the different-color inks are given different rates of fixing (different drying speeds) on a recording medium, to prevent undesirable color mixing due to bleeding of the different-color ink droplets at their boundaries. Namely, the color mixing at the boundaries can be prevented since one of the adjacent two dots of the inks of the different compositions is dried at a higher rate than the other dot.

If the technique disclosed in the above-identified U.S. Patent is applied to a color ink-jet printer having a plurality of rows of nozzles that are arranged to eject droplets of inks of respective different colors (e.g., yellow [Y], magenta [M], cyan [C] and black [B]), the same number of the ink droplets corresponding to one ink dot are ejected for each of the different colors, that is, the total volume of the ink droplets corresponding to one ink dot is the same for all of the different colors, when the gray-scale value at a picture element in question is the same for all of the four colors. Where the different-color inks have the respective different compositions as disclosed in the above-identified Japanese Publication, it is possible to reduce a risk of deterioration of quality of a printed image due to the color mixing at the adjacent ink dots of different colors. However, the different-color inks of different compositions have respective different drying speeds, and the viscosity of the ink having a relatively high drying speed may be excessively increased at the meniscus surface of the ink remaining in a given nozzle, due to evaporation of an aqueous component of the ink at the meniscus surface, which takes place if the ejection of the ink droplets from that nozzle is absent for a relatively long time. In this case, the nozzle may suffer from so-called "plugging" due to increased viscosity of the ink at the meniscus surface, leading to a failure to subsequently eject the ink droplets from that nozzle. In this respect, a color ink-jet printer is required to operate without not only the color mixing at the adjacent ink dots of different colors, but also the plugging of the nozzles due to the different compositions of the different-color inks.

SUMMARY OF THE INVENTION

It is therefore an object of the present invention to provide a color ink-jet printer which is arranged to minimize deterioration of quality of a printed image due to color mixing at adjacent ink dots of different colors while avoiding plugging of nozzles with dried ink.

After an extensive study in an effort to solve the drawbacks experienced in the prior art, the present inventor had a finding that deterioration of quality of a printed image due to color mixing, as recognized by an observer of the image, is primarily due to ink bleeding at the boundary between the black ink dots and the adjacent ink dots of the other colors. In other words, the inventor had a finding that where the color mixing at the boundary between the black ink dots and the adjacent ink dots of the other colors is substantially prevented, the color mixing if any at the boundary between the adjacent ink dots of those other colors would not significantly deteriorate the quality of the printed image. The present inventor conceived the present invention, based on this finding along with a recognition that the black ink is used at a considerably higher frequency than inks of the other colors, to effect solid printing so as to emphasize letters, for example, in a comparatively large area on the recording medium.

The object indicated above may be achieved according to a first aspect of this invention, which provides a color ink-jet printer comprising: a first ink ejecting portion operable to eject droplets of a black ink; a second ink ejecting portion operable to eject droplets of an ink of a color other than black, a first control portion operable to control the first ink ejecting portion such that a total volume of at least one droplet of the black ink ejected by the first ink ejecting portion to form each dot of the black ink on a recording medium is equal to a selected one of a plurality of different total volume values; and a second control portion operable to control the second ink ejecting portion such that a total volume of at least one droplet of the ink of the color other than black, which is ejected by the second ink ejecting portion to form each ink dot of the color other than black on the recording medium, is equal to another of the plurality of different total volume values which is smaller than the above-indicated selected one of the different total volume values.

In the color ink-jet printer constructed according to the above-indicated first aspect of the present invention, the total volume of the at least one ink droplet forming each ink dot of at least one color other than black is made smaller than that of the at least one ink droplet forming each black ink dot. Accordingly, the relatively small ink dots of the at least one color other than black are dried on or absorbed by the recording medium at a higher rate, than the relatively large black ink dots. Therefore, substantially no bleeding of the inks takes place at the boundary between the dots of the black ink and the ink dots of the other color. Further, the present color ink-jet printer is not required to use the black ink and the ink of the other color to have different compositions. Namely, the present printer may use the black ink and the other color ink which have substantially the same composition which is formulated to avoid undesirable plugging of nozzles of the first and second ink ejecting portions.

In the present invention, the total volume of the at least one droplet forming each black ink dot is made larger than that of the at least one droplet forming each ink dot of the other color, in view of a fact that the black ink is generally used at a considerably higher frequency than the ink of the other color, to effect solid printing so as to emphasize letters of words, for example, in a comparatively large area on the recording medium. In this respect, the printing speed of an image can be increased even where the printing of the image involves such solid printing with the black ink only.

In a first preferred form of the color ink-jet printer of the above-indicated first aspect of the present invention, the first and second control portions are operable to control the first and second ink ejecting portions such that the total volume of the above-indicated at least one droplet forming each dot of the black ink, and the total volume of the above-indicated at least one droplet forming each ink dot of the color other than black are respectively kept at the above-indicated one and another of the plurality of different total volume values, throughout entire operations of the first and second ink ejecting portions to print an image on the recording medium, irrespective of gray-scale values at respective picture elements of the image.

In one arrangement of the first preferred form of the invention described above, the first and second control portions are operable to select the above-indicated one and another of the plurality of different total volume values, on the basis of a presently selected one of a plurality of different print modes which correspond to respective different values of resolution of the image. In this case, the sizes of the black ink dots and the ink dots of the other color are determined so as to meet a desired value of resolution of the image. For instance, one of the different print modes is selected by the operator of the printer.

In a second preferred form of the color ink-jet printer of the first aspect of this invention, the first and second control portions are operable to select the above-indicated one and another of the plurality of different total volume values, on the basis of respective gray-scale values at respective picture elements of the image at which respective ink dots are to be formed by the first and second ink ejecting portions according to print data.

In a third preferred form of the color ink-jet printer of the first aspect of the invention, the first and second control portions are operable to select the total volume of the above-indicated at least one droplet forming each dot of the black ink, and the total volume of the above-indicated at least one droplet forming each ink dot of the color other than black, differently depending upon local areas of the image, as long as the total volume value of the above-indicated at least one droplet forming each black ink dot is made larger than the total volume value of the above-indicated at least one droplet forming each ink dot of the color other than black, in each local area of the image in which the black ink dots are adjacent to the ink dots of the color other than black.

In a fourth preferred form of first aspect of the invention, the color ink-jet printer further comprises a pulse-waveform-data memory for storing pulse-waveform data indicative of a plurality of different waveforms of drive pulse signals to be applied to the first and second ink ejecting portions to eject the droplets of the black ink and the ink of the color other than black, the plurality of different waveforms corresponding to the plurality of different total volume values, respectively, and the first and second control portions are operable to select respectively one and another of the plurality of different waveforms which respectively correspond to the above-indicated one and another of the plurality of different total volume values.

In the fourth preferred form of the color ink-jet printer of the first aspect of the invention described above, the total volume of at least one droplet forming each black ink dot and the total volume of at least one droplet forming each ink dot of the color other than black can be controlled with high degrees of efficiency and accuracy, by reading the appropriate waveforms of the drive pulse signal from the pulse-waveform-data memory.

In a fifth preferred form of the first aspect of the invention, the color ink-jet printer further comprises first and second pulse generators operable to generate drive pulse signals to be applied to the first and second ink ejecting portions such that the total volume of the above-indicated at least one droplet forming each dot of the black ink and the total volume of the above-indicated at least one droplet forming each ink dot of the color other than black are variable as the number of the above-indicated at least one droplet to be ejected from each of the first and second ink ejecting portions is changed while the volume of each of the above-indicated at least one droplet is kept constant.

In a sixth preferred form of the first aspect of the invention, the color ink-jet printer further comprises first and second pulse generators operable to generate drive pulse signals to be applied to the first and second ink ejecting portions such that the total volume of the above-indicated at least one droplet forming each dot of the black ink and the total volume of the above-indicated at least one droplet forming each ink dot of the color other than black are changed by changing the volume of at least one of the above-indicated at least one ink droplet to be ejected from each of the first and second ink ejecting portions. For instance, each ink dot is provided by only one ink droplet, and the volume of this ink droplet is changed to change the size of the ink dot.

In another preferred form of the color ink-jet printer of the first aspect of the invention, the second control portion is operable to control the second ink ejecting portion such that the total volume of the above-indicated at least one droplet ejected by the above-indicated second ink ejecting portion to form each ink dot of the color other than black is next smaller than the above-indicated selected one total volume value.

In a further preferred form of the first aspect of the invention, the color ink-jet printer further comprises a third ink ejecting portion operable to eject droplets of an ink of another color other than black, and a third control portion operable to control the third ink ejecting portion such that a total volume of at least one droplet of the ink of the above-indicated another color other than black, which is ejected by the third ink ejecting portion to form each ink dot of the above-indicated another color other than black on the recording medium, is equal to the above-indicated another of the plurality of different total volume values.

The object indicated above may be achieved according to a second aspect of the present invention, which provides a color ink-jet printer comprising: a first ink ejecting portion operable to eject droplets of a first ink of a first color; a second ink ejecting portion operable to eject droplets of a second ink of a second color other than the first color; a first control portion operable to control the first ink ejecting portion such that a total volume of at least one droplet of the first ink ejected by the first ink ejecting portion to form each dot of the first ink on a recording medium is equal to a first value, when an image is formed on the recording medium with a predetermined resolution, with a predetermined gray-scale value at a picture element corresponding to the above-indicated each dot of the first ink; and a second control portion operable to control the second ink ejecting portion such that a total volume of at least one droplet of the second ink ejected by the second ink ejecting portion to form each dot of the second ink on the recording medium, is equal to a second value smaller than the first value, when said image is formed on the recording medium with the above-indicated predetermined resolution, with the above-indicated predetermined gray-scale value at a picture element corresponding to each dot of the second ink.

In the color ink-jet printer constructed according to the above-indicated second aspect of the invention, the total volume of the at least ink droplet forming each dot of the second color is made smaller than that of the at least one ink droplet forming each dot of the first ink. Accordingly, the relatively small dots of the second ink are dried on or absorbed by the recording medium at a higher rate, than the relatively large dots of the first ink. Therefore, substantially no bleeding of the inks takes place at the boundary between the ink dots of the first and second colors. Further, the present color ink-jet printer is not required to use the inks of the first and second colors to have different compositions. Namely, the present printer may use the first and second inks of the respective different first and second colors which have substantially the same composition which is formulated to avoid undesirable plugging of nozzles of the first and second ink ejecting portions. Where dots of a third ink of a third color different from the first and second colors are formed, the total volume value of at least one droplet of this third ink is selected to be a third value, which is equal to be the first or second value indicated above. The present printer is advantageous particularly when the first color is black.

The object indicated above may be achieved according to a third aspect of the invention, which provides a color ink-jet printer comprising: a first ink ejecting portion operable to eject droplets of a black ink; a second ink ejecting portion operable to eject droplets of an ink of a color other than black; a pulse-waveform-data memory for storing pulse-waveform data indicative of a plurality of different waveforms corresponding to respective different total volume values of at least one droplet of each of the black ink and the ink of the color other than black; a first control portion operable to select, for the at least one droplet for forming each dot of the black ink on a recording medium, one of the plurality of different waveforms stored in the pulse-waveform-data memory, and control the first ink ejecting portion to eject the at least one droplet, on the basis of the selected one of the plurality of different waveforms; and a second control portion operable to select, for the at least one droplet for forming each dot of the color other than black on the recording medium, another of the plurality of different waveforms stored in the pulse-waveform-data memory, and control the second ink ejecting portion to eject the at least one droplet, on the basis of the selected another of the plurality of different waveforms, wherein a total volume of the at least one droplet of the black ink ejected by the first ejecting portion is larger than a total volume of the at least one droplet of the ink of the color other than black ejected by the second ink ejecting portion.

In a first preferred form of the above-indicated third aspect of the present invention, the color ink-jet printer further comprises a first pulse generator operable to generate a drive pulse signal to be applied to the first ink ejecting portion, on the basis of the above-indicated one of the plurality of different waveforms selected by the first control portion, and a second pulse generator operable to generate a drive pulse signal to be applied to the second ink ejecting portion, on the basis of the above-indicated another of the plurality of different waveforms selected by the second control portion.

In a second preferred form of the color-ink-jet printer of the above-indicated third aspect of the present invention, the first and second control portions are operable to select the above-indicated one and another of the plurality of different waveforms, on the basis of a presently selected one of a plurality of different print modes which correspond to respective different values of resolution of an image to be printed on the recording medium, irrespective of gray-scale values at respective picture elements of the image.

In a third preferred form of the color ink-jet printer of the above-indicated third aspect of the present invention, the first and second control portions are operable to select the above-indicated one and another of the plurality of different waveforms, on the basis of respective gray-scale values at respective picture elements of an image at which respective ink dots are to be formed by the first and second ink ejecting portions according to print data.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENTS

Figure 1:
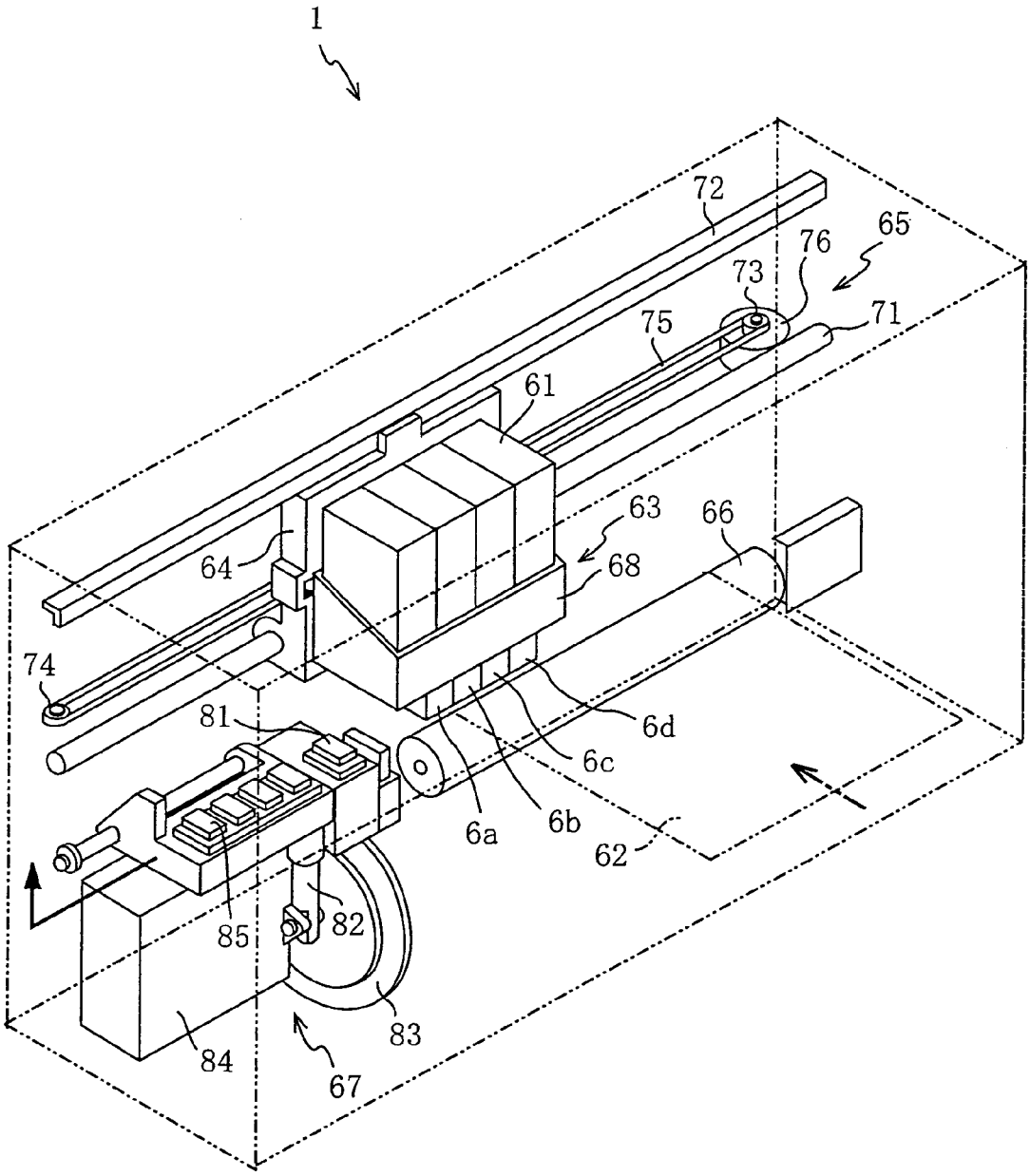
FIG. 1 is a perspective view schematically showing an internal arrangement of a color ink-jet printer constructed according to one embodiment of this invention.

Referring to the drawings, one preferred embodiment of the present invention will be described.

Reference is first made to the schematic perspective view of FIG. 1 showing the internal arrangement of a color ink-jet printer constructed according to one embodiment of this invention. As shown in FIG. 1, the color ink-jet printer indicated at 1 incorporates a head unit 63 having a frame 68 on which there are fixed four piezoelectric ink-jet heads 6*a*, 6*b*, 6*c* and 6*d* arranged to eject droplets of inks of respective four colors, namely, yellow (Y), magenta (M), cyan (C) and black (K). On the frame 68, there are also removably fixed four ink cartridges 61 which are filled with the inks of respective four colors and which are arranged to supply the inks to the respective ink-jet heads 6*a*–6*d*. The frame 68 is attached to a carriage 64 which is reciprocated along a straight line by a drive mechanism 65. The present color ink-jet printer 1 is further provided with a platen roller 66, which is disposed such that its axis of rotation is parallel to a direction of reciprocation of the carriage 64. The platen roller 66 is rotated by a drive device (not shown) to feed a recording medium in the form of a sheet of paper 62 in a feeding direction perpendicular to the direction of reciprocation of the carriage 64. The four ink-jet heads 6*a*–6*b* are arranged in the direction of reciprocation of the carriage 64, along a straight line which is parallel to the axis of rotation of the platen roller 66 and located adjacent to a circumferential surface of the platen roller 66.

The carriage 64 is supported by a guide shaft 71 and a guide plate 72 which are disposed so as to extend in the axial direction of the platen roller 66. The carriage 64 is slidable on these guide shaft and plates 71, 72 by the above-indicated drive mechanism 65, which includes a pair of pulleys 73, 74 rotatably disposed near the respective opposite ends of the guide shaft 71, and an endless belt 75 which connects the two pulleys 73, 74 and to which the carriage 64 is fixed.

The drive mechanism 65 further includes a drive motor 76 which is connected to the driving pulley 73 to rotate this pulley 73 in a selected one of opposite directions, for reciprocating the carriage 64 along the guide shaft and plate 71, 72, to thereby reciprocate the head unit 63 in the direction of reciprocation of the carriage 64.

The printer 1 is further provided with a sheet feeding mechanism (not shown) arranged to feed the paper sheet 62 from a sheet feeder cassette (not shown). The paper sheet 62 fed from the sheet feeder cassette is passed through a clearance or gap between an array of the ink-jet heads 6*a*–6*d* and the circumferential surface of the platen roller 66, when an image is printed on the paper sheet 62, with the droplets of inks ejected from the ink-jet heads 6*a*–6*d*. The paper sheet 62 with the printed image is ejected onto a paper tray (not shown) by a sheet ejecting mechanism (not shown).

Figure 2:
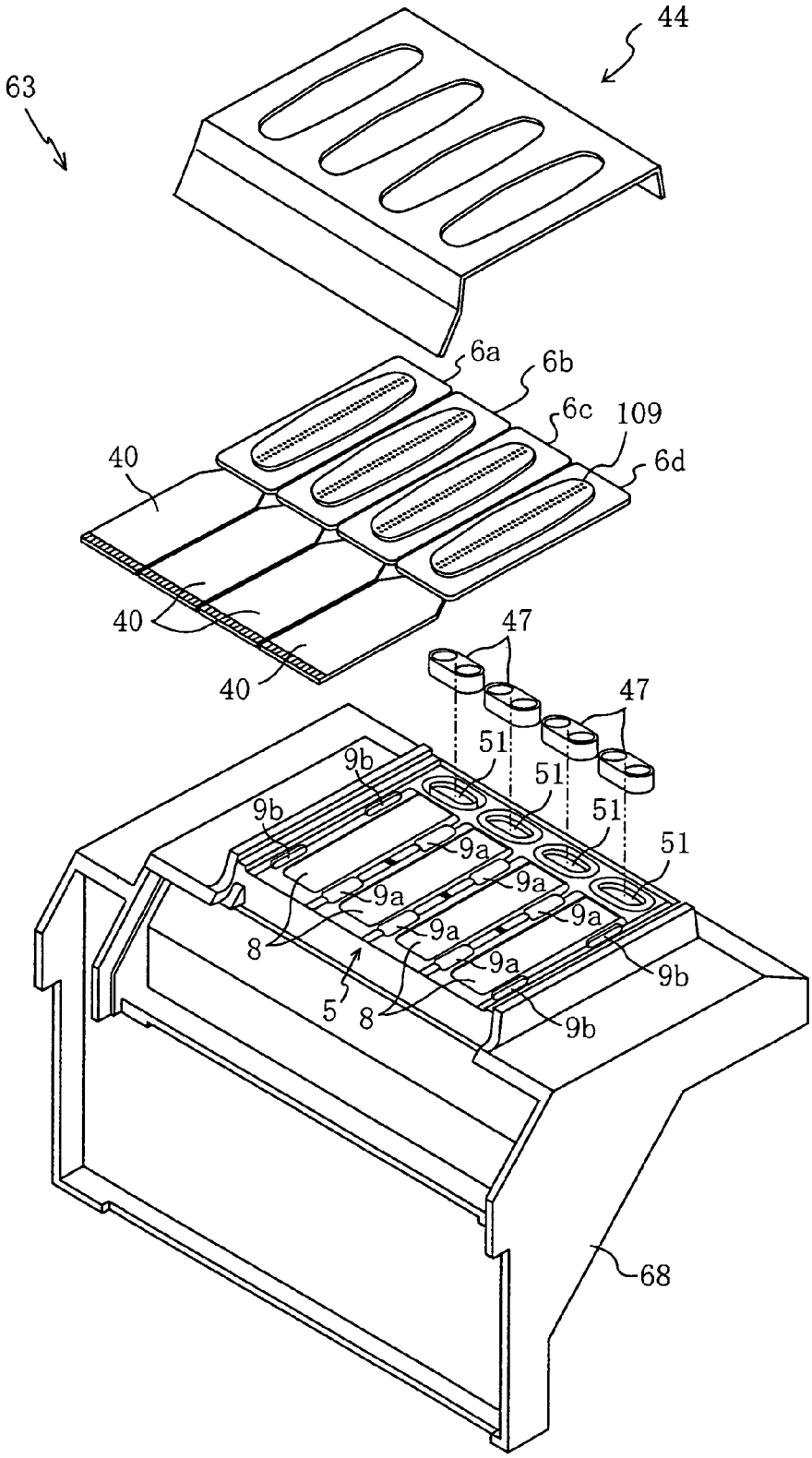
FIG. 2 is an exploded perspective view showing a head unit included in the color ink-jet printer of FIG. 1, when the head unit is vertically inverted.
Figure 3:
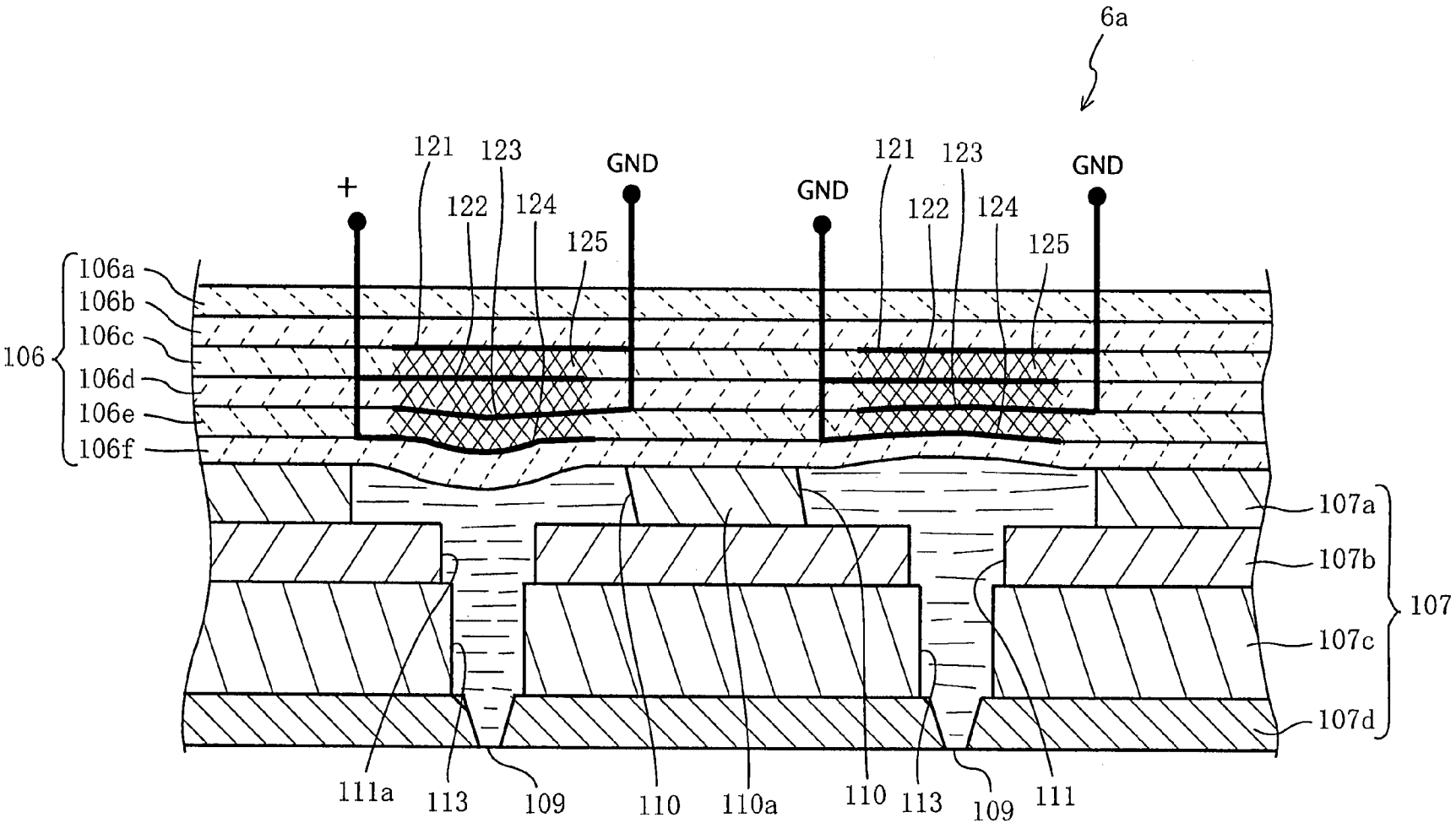
FIG. 3 is a fragmentary elevational view in cross section showing one of ink-jet heads of the head unit of FIG. 2.

The color ink-jet printer 1 is further provided with a purge mechanism 67 arranged to remove, by suction, poor-quality inks which remain in the ink-jet heads 6*a*–6*d* and which contain air bubbles and foreign matter. The purge mechanism 67 is located near one of the opposite axial ends of the platen roller 66 such that the purge mechanism 67 is spaced apart from the above-indicated one end of the platen roller 66 in the axial direction away from the other end, so that the four ink-jet heads 6*a*–6*b* are sequentially aligned with the purge mechanism 67, one after another, when the head unit 63 is returned to a predetermined home position by the drive mechanism 65. The purge mechanism 67 has a purge cap 81 which is arranged to cover a multiplicity of nozzles 109 which are open in the lower surface of each ink-jet head 6*a*, 6*b*, 6*c*, 6*d*, as shown in FIGS. 2 and 3. That is, the purge cap 81 is arranged to contact with an area of the lower surface of each head in which the nozzles 109 are open.

As shown in FIG. 1, the purge mechanism 67 includes a pump 82 which is driven by a cam 83, when the head unit 63 is located at a position near its home position and the nozzles 109 of a selected one of the ink-jet heads 6*a*–6*d* are covered by the purge cap 81. The poor-quality inks removed from the ink-jet heads 6*a*–6*d* by the purge mechanism 67 are discarded into a waste ink reservoir 84. Thus, the purge mechanism 67 functions to sequentially restore the four ink-jet heads 6*a*–6*d* to their normal state, by removing the air bubbles from the inks within the ink-jet heads upon initial filling of the inks, for thereby preventing failures of the ink-jet heads to eject the ink droplets due to growth of the air bubbles during a printing operation of the head unit 63. As shown in FIG. 1, four caps 85 are disposed near the purge cap 81, so that the nozzles 109 of the four ink-jet heads 6*a*–6*d* are covered by the respective four caps 85 when the head unit 63 is located at its home position after a printing operation.

Referring next to the exploded perspective view of FIG. 2 showing the head unit 63 in its vertically inverted posture, the frame 68 has a generally rectangular box structure which is open upwards as seen in FIG. 1 (downwards as seen in FIG. 2), so that the four ink cartridges 61 can be removably accommodated in a cartridge installation space within the box structure.

The frame 68 has a bottom wall 5 having an upper surface which partially defines the above-indicated installation space for accommodating the ink cartridges 61, and a lower surface (upper surface as seen in FIG. 2) to which the ink-jet heads 6*a*–6*d* are attached. This bottom wall 5 has four ink supply holes 51 formed therethrough between the above-indicated upper and lower surfaces such that the ink supply holes 51 are held in communication with ink outlet portions of the ink cartridges 61 accommodated in place in the cartridge installation space of the box structure of the frame 68. To the lower surface of the bottom wall 5, there are attached four rubber joints 47 which are arranged to connect the respective ink supply holes 51 to ink inlet portions of the respective ink-jet heads 6*a*–6*d*.

As shown in FIG. 2, the bottom wall 5 has four head support portions 8 in the form of rectangular stepped recesses formed in its lower surface, so that the four ink-jet heads 6*a*–6*d* are partially received in the respective recesses, and fixed to the bottom wall 5 with a UV-curable adhesive agent which fills respective slots 9*a*, 9*b* formed through the thickness of the bottom wall 5, near the recesses. The ink-jet heads 6*a*–6*d* thus supported by the head support portions 8 are covered by a covering member 44, which has four elongate oval openings as shown in FIG. 2, so that the rows of the nozzles 109 of the ink-jet heads 6*a*–6*d* are exposed through the respective openings. As also shown in FIG. 2, the four ink-jet heads 6*a*–6*d* are provided with respective flexible printed-circuit (FPC) boards 40 fixed thereto for applying drive pulse signals to their actuator units 106 (FIG. 3). As described below by reference to FIGS. 5A–5D, each drive pulse signal selectively has a ground potential and a positive potential.

Referring further to the fragmentary cross sectional view of FIG. 3, there is shown the ink-jet head 6*a*, by way of example. The other three ink-jet heads 6*b*, 6*c* and 6*d* have the same construction as the ink-jet head 6*a*, which will be described in detail. It is noted, however, that the four ink-jet heads 6*a*, 6*b*, 6*c* and 6*d* are assigned to eject droplets of a yellow (Y) ink, a magenta (M) ink, a cyan (C) ink and a black (K) ink, respectively. In the present embodiment, the ink-jet head 6*d* functions as a first ink ejecting portion, while the other ink-jet heads 6*a*, 6*b* and 6*c* function as a second ink ejecting portion. Alternatively, the ink-jet heads 6*a*, 6*b*, 6*c* and 6*d* are considered to function as respective four ejecting portions. For instance, the head 6*d* functions as the first ink ejecting portion, and the head 6*a* functions as the second ink ejecting portion, while the head 6*b* or 6*c* functions as a third ink ejecting portion.

As shown in FIG. 3, the ink-jet head 6*a* has an actuator unit 106 and a flow-passage unit 107 superposed on each other. The actuator unit 106 is driven or operated according to a drive pulse signal generated from a control portion 11 (shown in FIG. 4) of the printer 1, and the flow-passage unit 107 has a multiplicity of ink passages communicating with the respective nozzles 109. The actuator unit 106 and the flow-passage unit 107 are bonded together with a thermosetting adhesive agent such as an epoxy resin. Although the FPC boards 40 are bonded to the upper surface of the actuator unit 106, these FPC boards 40 are not shown in FIG. 3, in the interest of brevity.

The flow-passage unit 107 is a laminar structure consisting of three thin metal plates (a cavity plate 107*a*, a spacer plate 107*b* and a manifold plate 107*c*) formed of a metallic material, and a nozzle plate 107*d* formed of a synthetic resin material such as polyimide. The uppermost cavity plate 107*a* is bonded at its upper surface to the actuator unit 106.

The ink-jet head 6*a* has two parallel rows of pressure chambers 110 formed through the cavity plate 107*a* such that the pressure chambers 110 in each row are arranged and spaced apart from each other by partition walls 110*a*, in the longitudinal direction of the ink-jet head 6*a*. The pressure chambers 110 are filled with the yellow ink, so that droplets of the ink are ejected from the selected ones of the nozzles 109 upon selective operation of the corresponding local active portions of the actuator unit 106. The spacer plate 107*b* has a communication hole 111 for communication of each pressure chamber 110 at one of its opposite ends with the corresponding nozzle 109, and another communication hole (not shown) for communication of each pressure chamber 110 at the other end with a manifold passage (not shown) formed in the manifold plate 107*c*.

The manifold plate 107*c* has a communication hole 113 for communication between the communication hole 111 and the corresponding nozzle 109. Since the pressure chambers 110 are arranged in the two rows, the manifold plates 107*c* has two manifold passages corresponding to these two rows of the pressure chambers 110. Each of the manifold passages is elongated so as to extend in a direction of arrangement of the pressure chambers 110 of the corresponding row, and is located below that row. Each manifold passage is connected at one of its longitudinally opposite ends with the corresponding one of the four ink cartridges 61 through the corresponding one of the four ink supply holes 51 (shown in FIG. 2). Thus, the flow-passage unit 107 has a multiplicity of ink passages each of which extends from the manifold passage to the corresponding nozzle 109 through the above-indicated another communication hole, the pressure chamber 110 and the communication holes 111, 113.

The actuator unit 106 is a laminar structure consisting of six piezoelectric ceramic plates 106*a*–106*f* formed of lead zirconate titanate (PZT). Two common electrodes 121 are formed between the piezoelectric ceramic plates 106*b* and 106*c*, while two common electrodes 123 are formed between the piezoelectric ceramic plates 106*d* and 106*e*, such that the two common electrodes 121 are aligned with respective two areas of the flow-passage unit 107 in which the respective two rows of pressure chambers 110 are formed, and the two common electrodes 123 are aligned with those two areas, respectively. Two rows of multiple individual electrodes 122 are formed between the piezoelectric ceramic plates 106*c* and 106*d* such that the individual electrodes 122 are aligned with the respective pressure chambers 110 of the two rows, while two rows of multiple individual electrodes 124 are formed between the piezoelectric ceramic plates 106*e* and 106*f* such that the individual electrodes 124 are aligned with the respective pressure chambers 110 of the two rows.

The common electrodes 121, 123 are kept at the ground potential, and the individual electrodes 122, 124 are selectively energized according to the drive pulse signals. The portions of the piezoelectric ceramic plates 106*c*–106*e* which are located between the common electrodes 121, 123 and the individual electrodes 122, 124 function as active portions 125 which have been polarized in the direction of lamination of the plates 106*a*–106*f*, with an electric field applied thereto through the electrodes 121–124. When each individual electrode 122, 124 is given a predetermined positive potential, the corresponding active portion 125 is subjected to an electric field and is expanded in the direction of lamination while the corresponding local portion of the piezoelectric ceramic plates 106*a*, 106*b* maintain the original state, so that the active portion 125 is expanded so as to partially protrude into the corresponding pressure chamber 110, whereby the volume of the pressure chamber 110 is reduced, with a result of application of a pressure to the ink in the pressure chamber 110, causing the ink to be ejected from the nozzle 109.

FIG. 3 shows the two adjacent pressure chambers 110 placed in different states, for explaining the operation of the actuator unit 106. The individual electrodes 122, 124 corresponding to the left one of the pressure chamber 110 are given the predetermined positive potential, and the corresponding active portion 125 of the actuator unit 106 is expanded so as to be convex toward the left pressure chamber 110, so that the volume of the left pressure chamber 110 is reduced, whereby the ink is ejected from the nozzle 109 communicating with the left pressure chamber 110. On the other hand, the drive pulse signal to be applied to the individual electrodes 122, 124 corresponding to the right pressure chamber 110 is such that the individual electrodes 122, 124 are held at the ground potential, like the common electrodes 121, 123, so that the ink is not ejected from the nozzle 109 communicating with the right pressure chamber 110.

In the present embodiment, the ink-jet heads 6*a*–6*d* are operated to perform so-called "fill-before-fire" actions for ejecting droplets of ink. Where the fill-before-fire action is performed by the ink-jet head 6*a*, for example, all of the pressure chambers 110 are normally placed in a reduced-volume state, like the left pressure chamber 110 shown in FIG. 3. Namely, all of the individual electrodes 122, 124 are normally kept at the predetermined positive potential, so that the active portions 125 are all expanded to be convex toward the respective pressure chambers 110. The individual electrodes 122, 124 corresponding to each nozzle 109 from which the ink is required to be ejected are given the ground potential at appropriate timings, so that the volume of the corresponding pressure chamber 110 is increased, like the right pressure chamber 110 shown in FIG. 3. As a result, a negative pressure wave is generated in the pressure chamber 110, and the generated pressure wave propagates through the pressure chamber 110 in its longitudinal direction. When the negative pressure wave is changed into a positive pressure wave, the individual electrodes 122, 124 are again given the predetermined positive potential, so that the corresponding active portion 125 is expanded so as to be convex toward the pressure chamber 110, with a result of pressurizing the ink within the pressure chamber 110. This fill-before-fire action permits a high rate of ejection of the ink droplets with a comparatively low drive voltage.

Figure 4:
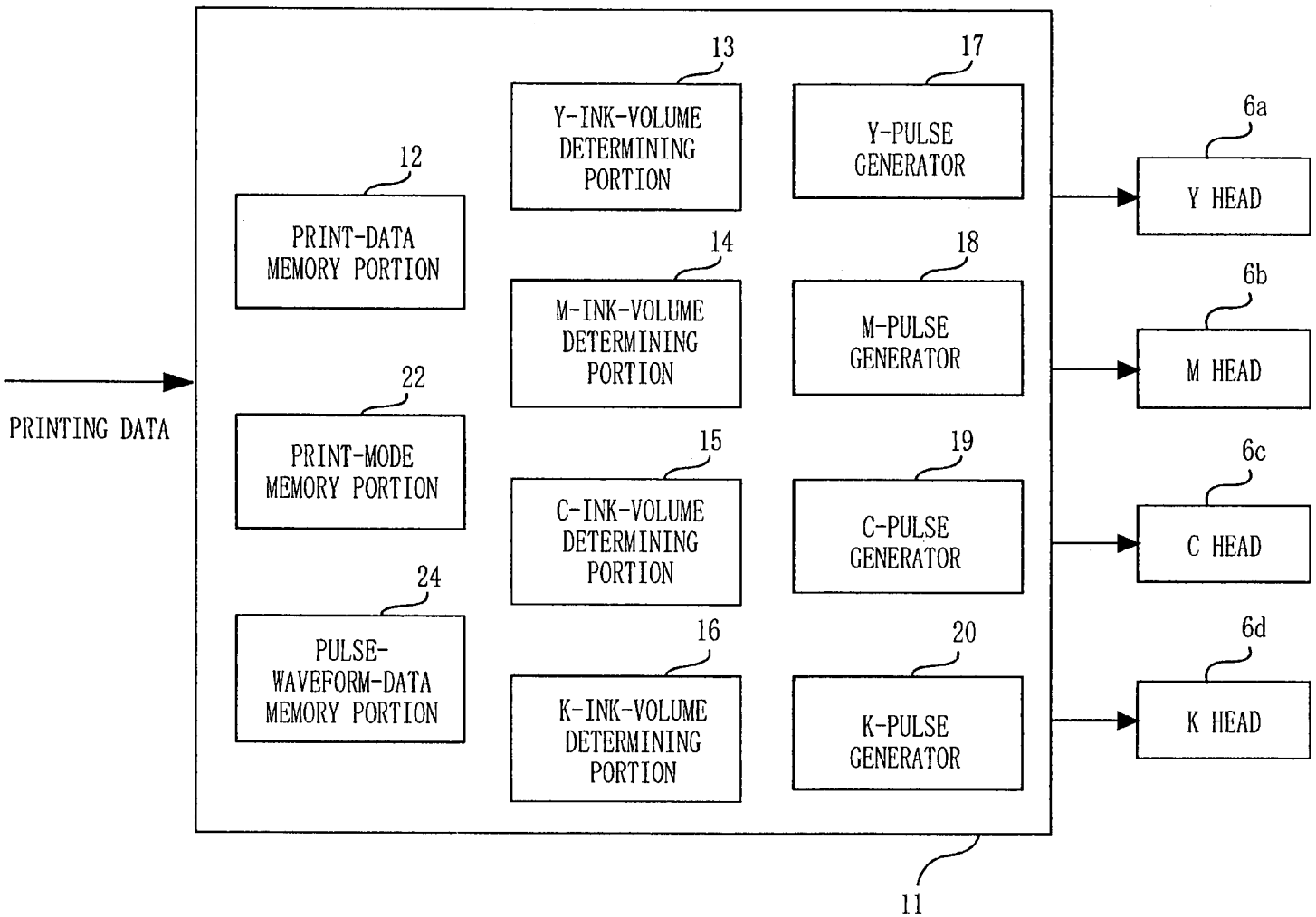
FIG. 4 is a block diagram illustrating a control portion of the color ink-jet printer of FIG. 1.

Referring further to the block diagram of FIG. 4, there will be described a control portion 11 of the color ink-jet printer 1, which is arranged to control the operations of the ink-jet heads 6*a*–6*d*. The control portion 11 includes a print-data memory portion 12 for storing print data received from an external device such as a personal computer. The print data to be stored in the print-data memory portion 12 includes bit map data representative of a gray-scale value (eight-bit data indicative of one of 256 gray-scale values) at each picture element of an image, for each of the four colors (YMCK).

The control portion 11 further includes a print-mode memory portion 22 and a pulse-waveform-data memory portion 24. The print-mode memory portion 22 is provided to store print-mode data indicative of one of a plurality of print modes (four modes consisting of a SUPER FINE mode, a FINE mode, a NORMAL mode and a DRAFT mode, in this specific embodiment), which has been selected by an operator of the printer 1, depending upon a desired quality of an image to be printed.

The pulse-waveform-data memory portion 24 is provided to store pulse-waveform data indicative of four different waveforms of the drive pulse signal to be applied to the individual electrodes 122, 124 of the actuator unit 106, to eject at least one droplet of ink from the corresponding nozzle 109. The four different waveforms correspond to respective four ink dots of different sizes, namely, a large dot, a medium dot, a small dot and a very small dot, which correspond to respective four different total volume values of 36 pl, 24 pl, 12 pl and 5 pl of at least one ink droplet, as described below in detail.

FIGS. 5A–5D show the four different waveforms of the drive pulse signal corresponding to the respective large, medium, small and very small dots. In these figures, high level (H) and low level (L) respectively correspond to a low voltage and a high voltage applied to the individual electrodes 122, 124. The waveform of the drive pulse signal of FIG. 5A for the large ink dot (36 pl) has four high-level periods H11, H12, H13 and H14 (for placing the pressure chamber 110 in an increased-volume state, like the right pressure chamber 110 shown in FIG. 3), and low-level periods (for placing the pressure chamber 110 in the reduced-volume state, like the left pressure chamber 110 shown in FIG. 3) adjacent to the high-level periods. Upon termination of the first three high-level periods H11, H12 and H13 (each of which is about 4–6 μs), respective three ink droplets (each having a volume of 12 pl) are ejected from the corresponding nozzle 109 by the above-indicated fill-before-fire actions during a feeding movement of the carriage 64, so that one large ink dot (36 pl) is formed by the three ink droplets which overlap each other on the paper sheet 62. The fourth high-level period H14 (which is about 3 μs) is provided not for ejecting an ink droplet, but for offsetting a variation in the ink pressure remaining in the pressure chamber 110 in question, in order to avoid an adverse influence of the present ink ejection on the next ink ejection associated with the same pressure chamber 110.

Figure 5A:
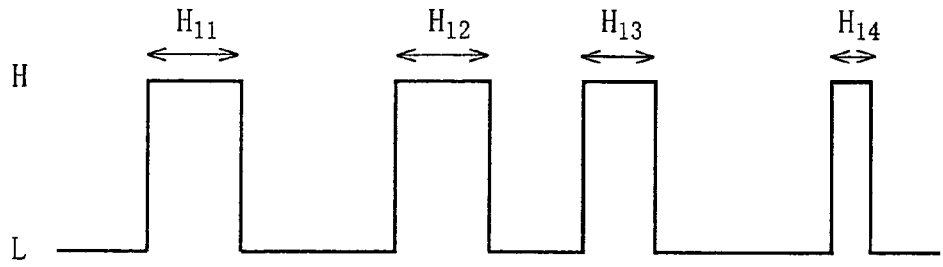
FIGS. 5A–5D are views indicating patterns of drive pulse signals to be applied to the ink-jet head of FIG. 3.
Figure 5B:
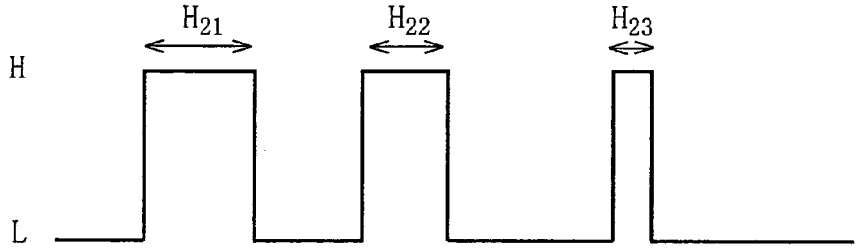

The waveform of the drive pulse signal of FIG. 5B for the medium ink dot (24 pl) has three high-level periods H21, 22 and H23, and the adjacent low-level periods. Upon termination of the first two high-level periods H21 and H22 (each of which is about 4–6 μs), respective two ink droplets (each having a volume of 12 pl) are ejected from the corresponding nozzle 109 by the above-indicated fill-before-fire actions, so that one medium ink dot (24 pl) is formed by the two ink droplets which partially overlap each other on the paper sheet 62. The third high-level period H23 (which is about 3 μs) is provided not for ejecting an ink droplet, but for offsetting a variation in the ink pressure remaining in the pressure chamber 110 in question.

Figure 5C:
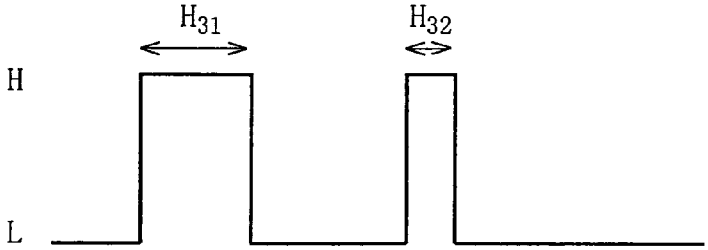

The waveform of the drive pulse signal of FIG. 5C for the small ink dot (12 pl) has two high-level periods H31 and H32, and the adjacent low-level periods. Upon termination of the first one high-level period H31 (which is about 4–6 μs), one ink droplet (having a volume of 12 pl) is ejected from the corresponding nozzle 109 by the above-indicated fill-before-fire action, so that one small ink dot (12 pl) is formed by the one ink droplet on the paper sheet 62. The second high-level period H32 (which is about 3 μs) is provided not for ejecting an ink droplet, but for offsetting a variation in the ink pressure remaining in the pressure chamber 110 in question.

Figure 5D:
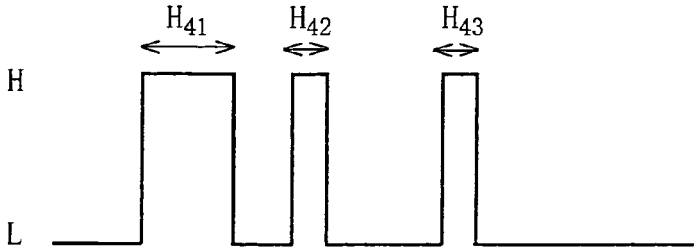

The waveform of the drive pulse signal of FIG. 5D for the very small ink dot (5 pl) has three high-level periods H41, H42 and H43, and the adjacent low-level periods. The first one high-level period H41 (which is about 4–6 μs) for ejecting one ink droplet (having a volume of 12 pl) is followed by the relatively short first low-level period which precedes the second high-level period H42 (which is about 2 μs), so that a trailing end portion of an ink droplet being ejected from the corresponding nozzle 109 is fed back into the nozzle 109 by the drawing action caused by the second short high-level period H42, whereby the ink droplet actually ejected from the nozzle 109 has a volume of about 5 pl. As a result, one very small ink dot (5 pl) is formed on the paper sheet 62. The third high-level period H43 (which is about 3 μs) is provided not for ejecting an ink droplet, but for offsetting a variation in the ink pressure remaining in the pressure chamber 110 in question.

The control portion 11 further includes four ink-volume determining portions 13, 14, 15 and 16 corresponding to the respective four colors Y, M, C and K, that is, a Y-ink-volume determining portion 13, an M-ink-volume determining portion 14, a C-ink-volume determining portion 15 and a K-ink-volume determining portion 16. The ink-volume determining portions 13–16 are arranged to determine the total ink volume value to be ejected from each nozzle 109 of the corresponding ink-jet heads 6*a*–6*d*, irrespective of the gray-scale value at the picture element in question, but on the basis of the presently selected print mode indicated by the print-mode data stored in the print-mode memory 22. The Y-ink-volume, M-ink-volume and C-ink-volume determining portions 13–15 determine the total volume of each of the yellow, magenta and cyan inks such that this total volume is smaller than the total volume of the black ink to be determined by the K-ink-volume determining portion 16, whatever the presently selected print mode is. Thus, the total volume of the at least one droplet forming each black ink dot ejected onto the paper sheet 62 is kept at a value which is determined depending upon the presently selected print mode, for all of the black ink dots throughout the operations of the ink-jet heads 6*a*–6*d* to print an image on the paper sheet 62, irrespective of the gray-scale value at each picture element of the image. Similarly, the total volume of the at least one droplet forming each dot of the other three colors ejected onto the paper sheet is kept at another value which is determined depending upon the presently selected print mode, for all of the ink dots of those other colors throughout the operations of the ink-jet heads 6*a*–6*d*, irrespective of the gray-scale value at each picture element of the image, such that the above-indicated another value for the dots of the other colors is smaller than the value for the dots of the black color. Thus, the total volume values of each black ink dot and each ink dot of the other colors, that is, the sizes of the black ink dots and the ink dots of the other colors are determined by the print mode selected by the operator of the printer 1, so that the image can be printed on the paper sheet 62, with a quality desired by the operator, namely, so as to meet an operator's desired value of resolution of the image. In this embodiment, the gray-scale image may be obtained by a suitable gray-scale reproduction technique such as a dither method and a density pattern method.

Described in detail by reference to Table 1 given below, the large total volume value (36 pl) is selected to form a large ink dot of the black color, while the medium total volume value (24 pl) is selected to form medium ink dots of the other colors, when the DRAFT mode is selected as the print mode. When the NORMAL mode is selected, the medium total volume value (24 pl) is selected to form a medium ink dot of the black color, while the small total volume value (12 pl) is selected to form small ink dots of the other colors. When the FINE mode is selected, the small total volume value (12 pl) is selected to form a small ink dot of the black color, while the very small total volume value (5 pl) is selected to form very small ink dots of the other colors. When the SUPER FINE mode is selected, the very small total volume value (5 pl) is selected to form a very small ink dot of the black color and very small ink dots of the other colors. Accordingly, the resolution of a printed image (density of the ink dots formed per unit area on the paper sheet 62) is increased as the print mode is changed in the direction from the DRAFT mode toward the SUPER FINE mode through the NORMAL and FINE modes. In the SUPER FINE mode wherein the very small total volume value (5 pl) is selected for not only the ink dot of the black color but also the ink dots of the other colors, substantially no bleeding of the black ink from the black ink dot to the ink dots of the other colors takes place, so that the printed image does not suffer from a problem of color mixing at the boundary of the ink dots of the different colors.

TABLE 1

Total Volumes of Ink Dots of Different Colors

| Black (K) Dot | Yellow (Y), Magenta (M), and Cyan (C) Dots | Selected Print Mode |
|---|---|---|
| LARGE | MEDIUM | DRAFT |
| MEDIUM | SMALL | NORMAL |
| SMALL | VERY SMALL | FINE |
| VERY SMALL | VERY SMALL | SUPER FINE |

The control portion 11 further includes four pulse generators 17, 18, 19, 20 for the respective colors Y, M, C and K, namely, a Y-pulse generator 17, an M-pulse generator 18, a C-pulse generator 19 and a K-pulse generator 20. The pulse generators 17–20 are arranged to generate drive pulse signals of appropriate waveforms to be applied to the respective ink-jet heads 6*a*–6*d*, on the basis of the total volume values of at least one droplet of ink determined by the ink-volume determining portions 13–16, and according to the waveform patterns stored in the pulse-waveform-data memory portion 24, so that the ink dots of the black color and the ink dots of the other colors which are ejected from the nozzles 109 of the ink-jet heads 6*a*–6*d* have the sizes corresponding to the determined total volume values. The drive pulse signals generated by the pulse generators 17–20 are applied to the respective ink-jet heads 6*a*–6*d*.

The control portion 11 including the various portions 12–20, 22, 24 is constituted by a central processing unit (CPU), a random-access memory (RAM), a read-only memory (ROM), etc. The ROM serves as the pulse-waveform-data memory portion 24 storing the pulse-waveform data, and stores other software such as control programs and data for various operations to be performed by the control portion 11.

In the present embodiment, the print-data memory portion 12, print-mode memory portion 22 and K-ink-volume determining portion 16 cooperate with each other to constitute a first control portion, while the print-data memory portion 12 and the print-mode memory portion 22 cooperate with each of the Y-ink-volume, M-ink-volume and C-ink-volume determining portions 13, 14 and 15 to constitute a second control portion. The first control portion is operable to control the actuator unit 106 of the ink-jet head 6*d* such that a total volume of at least one droplet of a black ink ejected by the ink-jet head 6*d* to form each black ink dot on the paper sheet 62 is equal to a selected one of a plurality of different total volume values (36 pl, 24 pl, 12 pl and 5 pl), while the second control portion is operable to control the actuator unit 106 of the ink-jet heads 6*a*, 6*b* and 6*c* such that a total volume of at least one droplet of each of yellow, magenta and cyan inks, which is ejected by the ink-jet heads 6*a*, 6*b*, 6*c* to form each ink dot of these colors on the paper sheet 62 is equal to another of the different total volume values which is smaller than that of the ink-jet head 6*d*. Alternatively, the determining portions 13–16 are considered to function as parts of respective four control portions. For instance, the determining portion 16 functions as part of the first control portion, and the determining portion 13 functions as part of the second control portion, while the determining portion 14 or 15 functions as part of a third control portion.

Figure 6:
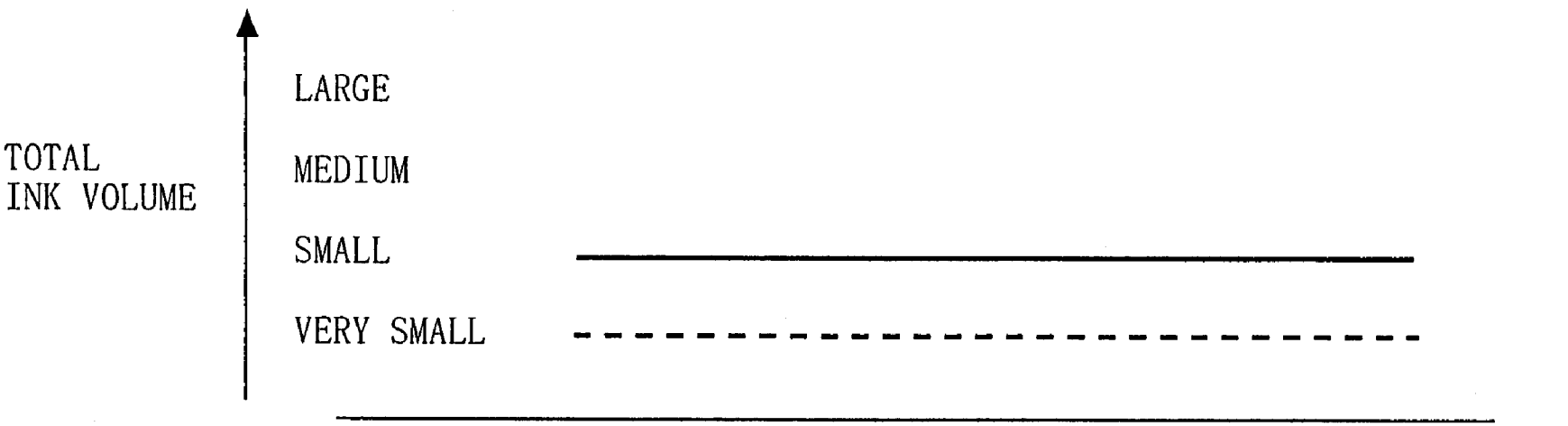
FIG. 6 is a time chart illustrating an example of a combination of a total volume of droplets of one black ink dot on a paper sheet, and a total volume of droplets of one yellow ink dot, one magenta ink dot and one cyan ink dot on the paper sheet, when the color ink-jet printer of FIG. 1 is placed in a fine print mode.
Figure 7:
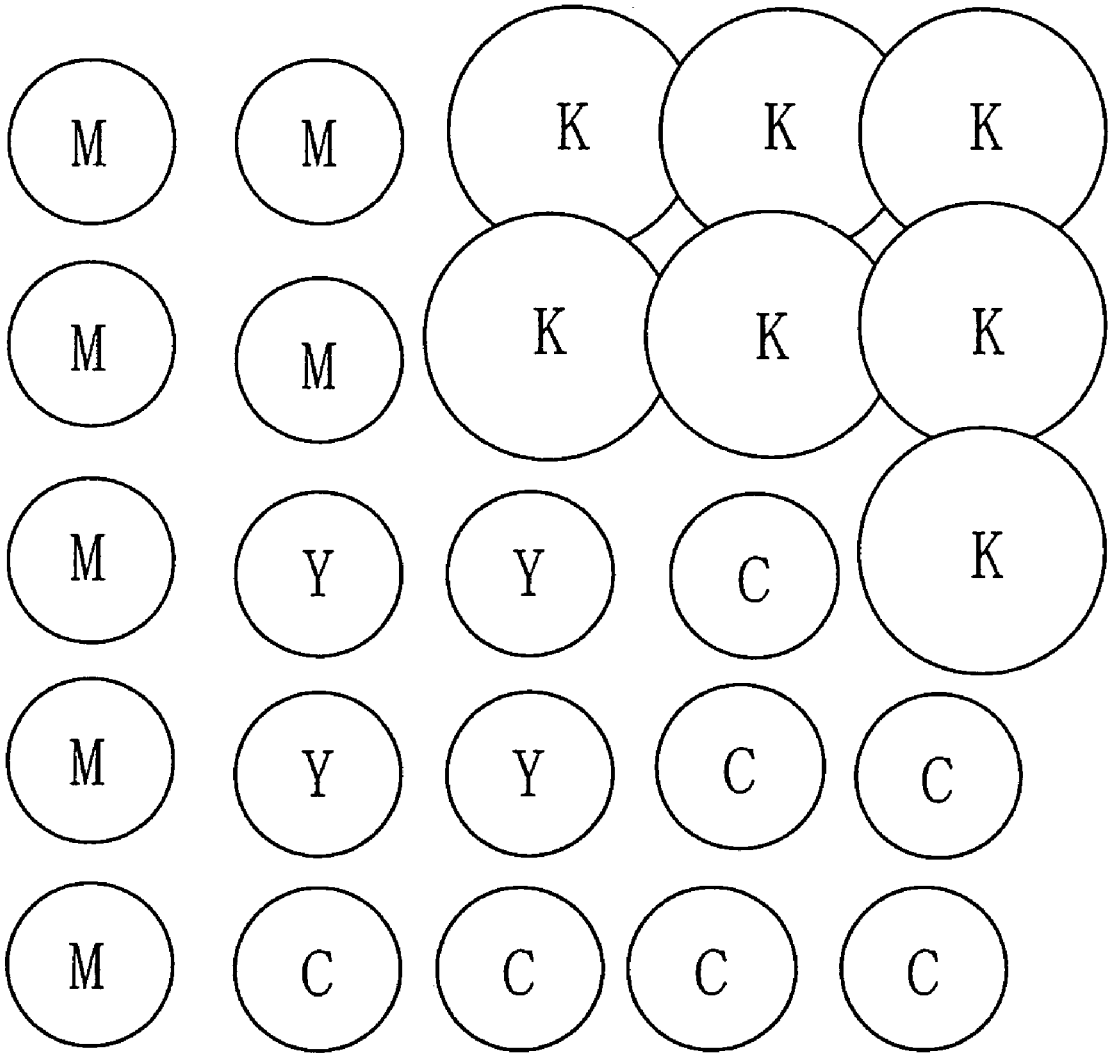
FIG. 7 is a view illustrating an example of a pattern of ink dots of the different-color inks formed on the paper sheet in the color ink-jet printer of FIG. 1.

Referring further to FIGS. 6 and 7, there will be described an example of a printing operation of the present color ink-jet printer 1 to form an image on the paper sheet 62. FIG. 6 is a time chart illustrating an example of a combination of the total volume of one black ink dot to be formed on the paper sheet 62, and the total volume of each of one yellow ink dot, one magenta ink dot and one cyan ink dot to be formed on the paper sheet 62, and FIG. 7 is a view illustrating an example of a pattern of ink dots of the different-color inks formed on the paper sheet 62 by the color ink-jet printer 1.

In the specific example of FIG. 6, the FINE print mode is selected, so that the small total volume value is selected to form the small black ink dots on the paper sheet 62, as indicated in FIG. 7, while the very small total value is selected to form the very small yellow, magenta and cyan ink dots on the paper sheet 62, as also indicated in FIG. 7, throughout the printing operation in the FINE print mode. Accordingly, the yellow, magenta and cyan ink dots are dried at a higher rate or absorbed by the paper sheet 62 at a higher rate, than the black ink dots. Therefore, substantially no bleeding of the inks takes place at the boundary between the dots of the black ink and the dots of the yellow, magenta and cyan inks. Even where some bleeding of the inks takes place at the boundary between the yellow, magenta and cyan ink dots, this bleeding does not have a significant influence on the quality of the printed image. Further, the black, yellow, magenta and cyan inks used by the present color ink-jet printer 1 have substantially the same composition which is formulated to avoid undesirable plugging of the nozzles 109 of the ink-jet heads 6*a*–6*d* due to drying of the inks.

In the present embodiment wherein the total volume of the at least droplet forming each blank ink dot is made larger than that of the at least one droplet forming each ink dot of the other colors, except in the SUPER FINE print mode, the printing speed of an image can be increased even where the printing of the image involves solid printing with the black ink only. In this respect, it is noted that the black ink is generally used at a considerably higher frequency than the inks of the other colors, to effect the solid printing so as to emphasize letters of words, for example, in a comparatively large area on the recording medium.

As shown in TABLE 1, the total volume of at least one droplet forming each black ink dot and the total volume of at least one droplet forming each ink dot of the other colors are selected to be the predetermined different volume values (e.g., 12 pl and 5 pl in the FINE print mode) which are adjacent to each other, so that the difference between these two total volume values is relatively small. Accordingly, even where the black ink dots and the ink dots of the other colors are formed alternately in the direction of feeding of the carriage 64 (ink-jet heads 6*a*–6*b*), it is not necessary to change the feeding speed of the carriage 64 depending upon the size of the ink dot being formed, so that the printing operation can be performed with high efficiency, at a relatively high feeding speed of the carriage 64. If the above-indicated difference is relatively large, the feeding speed of the carriage 64 must be determined to be relatively low depending upon the ink dots of the smaller size (the smaller total volume value).

It will be understood from the foregoing description that the present color ink-jet printer 1 is capable of performing a printing operation with high efficiency at a relatively high feeding speed of the carriage 64, while minimizing undesirable deterioration of quality of a printed image due to color mixing at the boundary of the ink dots and plugging of the nozzles with the dried ink.

The present embodiment is further arranged such that the pulse-waveform-data memory 24 stores pulse-waveform data indicative of four pulse waveforms corresponding to the large, medium, small and very small ink dots, and such that the ink-volume determining portions 13–16 read out the appropriate pulse waveforms from the pulse-waveform-data memory 24, for the respective ink-jet heads 6*a*–6*d* corresponding to the four different colors, on the basis of the presently selected print mode indicated by the print-mode data stored in the print-mode memory portion 22. This arrangement permits efficient and accurate control of the ink-jet heads 6*a*–6*d* so as to suitably determine the ink dot sizes for the different colors.

While the embodiment described above is arranged such that the size of the black ink dots and the size of the ink dots of the other colors are determined or selected on the basis of the presently selected print mode, the sizes of the black ink dots and the ink dots of the other colors may be selected on the basis of the gray-scale value at picture elements of the image at which respective ink dots are to be formed by the ink-jet heads 6*a*–6*d* according to the print data. In the NORMAL print mode of TABLE 1, for instance, the total volume of one black ink dot may be determined such that the total volume is variable in steps from among the medium total volume value, the small total volume value, and the very small total volume value, according to the gray-scale values at corresponding picture elements, while the total volume of each ink dot of the other colors may be determined such that the total volume is variable in steps from among the small total volume value and the very small total volume value, according to the gray-scale values at corresponding picture elements. In this second embodiment, too, the size of each blank ink dot (total volume value of at least one droplet forming each black ink dot) is made larger than that of the ink dots of the yellow, magenta and cyan inks, except when the very small black ink dot (very small total volume value of 5 pl) is selected, as in the first embodiment. In this embodiment, the size of each black ink dot is determined such that the size increases with an increase in the gray-scale value at the corresponding picture element.

In the first and second embodiments described above, the pulse generators 17–20 are arranged to generate the drive pulse signals to be applied to the ink-jet heads 6*a*–6*d* such that the number of at least one ink droplet (12 pl) to be ejected from the nozzle 109 to form each dot on the paper sheet 62 is changed depending upon the presently selected print mode or the gray-scale values at the corresponding picture elements, to select one of three sizes of each ink dot, namely, to select one of the large dot (36 pl), medium dot (24 pl) and small dot (12 pl), while the volume of each ink droplet is kept constant. In a third embodiment of this invention, however, the size of each ink dot is changed by changing the volume of each of at least one ink droplet to be ejected from the nozzle 109 to form each dot, by controlling a drive voltage to be applied to the individual electrodes 122, 124, or the waveform of a drive pulse signal to apply the drive voltage.

In the illustrated embodiments described above, the total volume values of the dots of the yellow, magenta and cyan inks are next smaller than the total volume value of the dots of the black ink, in the DRAFT, NORMAL and FINE print modes, as indicated in TABLE 1. However, the combinations of the total volume values are not limited to those indicated in TABLE 1. For instance, when the large black dots are selected, the small or very small dots of the yellow, magenta and cyan inks may be selected. Although the four ink-jet heads 6*a*–6*d* corresponding to the four different colors (Y, M, C and K) are provided in the illustrated embodiments, a color ink-jet printer may include two, three, five or more ink-jet heads which correspond to respective different colors, provided these colors include black.

While the illustrated embodiments are arranged such that a desired one of a plurality of different print modes is selected by the operator of the printer 1, the principle of the present invention is equally applicable to a color ink-jet printer in which only one print mode is available.

In the first and third embodiments described above, the size of the black ink dots and the size of the ink dots of the other colors are determined or selected to be respective constant values in the entire area of the image, irrespective of the gray-scale values at the corresponding picture elements at which respective ink dots are to be formed by the ink-jet heads 6*a*–6*d* according to the print data which are stored in the print-data memory portion 12 to print a desired image. However, the determination of the sizes of the black ink dots and the ink dots of the other colors may be made differently depending upon local areas of the image, as long as the total volume value of at least one droplet forming each black ink dot is made larger than the total volume value of at least one droplet forming each ink dot of the other colors, in each local area of the image in which the black ink dots are adjacent to the ink dots of the other color or colors. Described more specifically, in the NORMAL print mode of TABLE 1 of the illustrated first embodiment, for instance, the total volume of one black ink dot is kept constant at the medium total volume value while the total volume of each ink dot of the other color or colors is kept constant at the small total volume value in the entire area of the image. However, in one local area of the image, the medium total volume may be selected to form the medium ink dot of the black color and the small total volume may be selected to form the small ink dot of the other color or colors, while, in another local area of the image, the small total volume may be selected to form the small ink dot of the black color and the very small total volume may be selected to form the very small ink dot of the other color or colors. Further, the total volume value of at least one droplet forming each black ink dot need not be made larger than the total volume value of at least one droplet forming each ink dot of the other color or colors in a local area of the image in which the black ink dots are not adjacent to the ink dots of the other color or colors.

What is claimed is:

1. A color ink-jet printer comprising:

a first ink ejecting portion operable to eject droplets of a black ink;

a second ink ejecting portion operable to eject droplets of an ink of a color other than black;

a first control portion operable to control said first ink ejecting portion such that a total volume of at least one droplet of said black ink ejected by said first ink ejecting portion to form each dot of the black ink on a recording medium is equal to a selected one of a plurality of different total volume values; and a second control portion operable to control said second ink ejecting portion such that a total volume of at least one droplet of the ink of said color other than black, which is ejected by said second ink ejecting portion to form each ink dot of said color other than black on the recording medium, is equal to another of said plurality of different total volume values which is smaller than said selected one total volume value, and wherein said first and second control portions control said first and second ink ejecting portions such that a relationship between said selected one total volume value of the at least one droplet of said black ink and said another total volume value of the at least one droplet of the ink of said color other than black changes when a presently selected print mode of the color ink-jet printer is changed from one mode to another, wherein said first and second control portions are operable to select said one and another of said plurality of different total volume values, on the basis of said presently selected print mode that is selected from a plurality of different print modes which correspond to respective different values of resolution of said image.

2. The color ink-jet printer according to claim 1, wherein said first and second control portions are operable to control said first and second ink ejecting portions such that the total volume of said at least one droplet forming each dot of the black ink, and the total volume of said at least one droplet forming each ink dot of said color other than black are respectively kept at said one and another of said plurality of different total volume values, throughout entire operations of said first and second ink ejecting portions to print an image on the recording medium, irrespective of gray-scale values at respective picture elements of said image.

3. The color ink-jet printer according to claim 1, wherein said first and second control portions are operable to select said one and another of said plurality of different total volume values, on the basis of respective gray-scale values at respective picture elements of an image to be printed on the recording medium at which respective ink dots are to be formed by said first and second ink ejecting portions according to print data.

4. The color ink-jet printer according to claim 1, wherein said first and second control portions are operable to select the total volume of said at least one droplet forming each dot of the black ink, and the total volume of said at least one droplet forming each ink dot of said color other than black, differently depending upon local areas of an image to be printed on the recording medium, as long as the total volume value of said at least one droplet forming each black ink dot is made larger than the total volume value of said at least one droplet forming each ink dot of said color other than black, in each local area of the image in which the black ink dots are adjacent to the ink dots of said color other than black.

5. The color ink-jet printer according to claim 1, further comprising a pulse-waveform-data memory for storing pulse-waveform data indicative of a plurality of different waveforms of drive pulse signals to be applied to said first and second ink ejecting portions to eject the droplets of the black ink and the ink of said color other than black, said plurality of different waveforms corresponding to said plurality of different total volume values, respectively, and wherein said first and second control portions are operable to select respectively one and another of said plurality of different waveforms which respectively correspond to said one and another of said plurality of different total volume values.

6. The color ink-jet printer according to claim 1, further comprising first and second pulse generators operable to generate drive pulse signals to be applied to said first and second ink ejecting portions such that the total volume of said at least one droplet forming each dot of the black ink and the total volume of said at least one droplet forming each ink dot of said color other than black are variable as the number of said at least one droplet to be ejected from each of said first and second ink ejecting portions is changed while the volume of each of said at least one droplet is kept constant.

7. The color ink-jet printer according to claim 1, further comprising first and second pulse generators operable to generate drive pulse signals to be applied to said first and second ink ejecting portions such that the total volume of said at least one droplet forming each dot of the black ink and the total volume of said at least one droplet forming each ink dot of said color other than black are changed by changing the volume of at least one of said at least one ink droplet to be ejected from each of said first and second ink ejecting portions.

8. The color ink-jet printer according to claim 1, wherein said second control portion is operable to control said second ink ejecting portion such that the total volume of said at least one droplet ejected by said second ink ejecting portion to form each ink dot of said color other than black is next smaller than said selected one total volume value.

9. The color ink-jet printer according to claim 1, further comprising a third ink ejecting portion operable to eject droplets of an ink of another color other than black, and a third control portion operable to control said third ink ejecting portion such that a total volume of at least one droplet of the ink of said another color other than black, which is ejected by said third ink ejecting portion to form each ink dot of said another color other than black on the recording medium, is equal to said another of said plurality of different total volume values.

10. The color ink-jet printer according to claim 1, further comprising a print-mode memory portion operable to store said presently selected print mode indicative of one of first and second print qualities, said first print quality being lower than said second print quality, and wherein said second control portion controls said second ink ejecting portion such that said another total volume value is smaller than said selected one total volume value if the presently selected print mode indicates said first print quality.

11. The color ink-jet printer according to claim 10, wherein said second control portion controls said second ink ejecting portion such that said another total volume value is not smaller than said selected one total volume value if the presently selected print mode indicates said second print quality.

12. The color ink-jet printer according to claim 1, wherein said first and second control portions control said first and second ink ejecting portions, to change said selected one total volume value of the at least one droplet of said black ink and said another total volume value of the at least one droplet of the ink of said color other than black when said presently selected print mode is changed from said one mode to another, such that the changed another total volume value is smaller than the changed selected one total volume value.

13. The color ink-jet printer according to claim 1, wherein said first and second control portions control said first and second ink ejecting portions such that said another total volume value of the at least one droplet of the ink of said color other than black is kept smaller than said selected one total volume value of the at least one droplet of said black ink, after said presently selected print mode is changed from one mode to another.

14. A color ink-jet printer comprising:

a first ink ejecting portion operable to eject droplets of a first ink of a first color;

a second ink ejecting portion operable to eject droplets of a second ink of a second color other than said first color;

a first control portion operable to control said first ink ejecting portion such that a total volume of at least one droplet of said first ink ejected by said first ink ejecting portion to form each dot of said first ink on a recording medium is equal to a first value, when an image is formed on the recording medium with a predetermined resolution, with a predetermined gray-scale value at a picture element corresponding to said each dot of said first ink; and a second control portion operable to control said second ink ejecting portion such that a total volume of at least one droplet of said second ink ejected by said second ink ejecting portion to form each dot of said second ink on the recording medium, is equal to a second value smaller than said first value, when said image is formed on the recording medium with said predetermined resolution, with said predetermined gray-scale value at a picture element corresponding to said each dot of said second ink, and wherein said first and second control portions control said first and second ink ejecting portions such that a relationship between said first value of the total volume of the at least one droplet of said first ink and said second value of the total volume of the at least one droplet of said second ink changes when a presently selected print mode of the color ink-jet printer is changed from one mode to another wherein said first and second control portions are operable to select said one first and second values, on the basis of said presently selected print mode that is selected from a plurality of different print modes which correspond to respective different values of resolution of said image.

15. The color ink-jet printer according to claim 14, further comprising a third ink ejecting portion operable to eject droplets of a third ink of a third color other than said first and second colors, and a third control portion operable to control said third ink ejecting portion such that a total volume of at least one droplet of said third ink ejected by said third ink ejecting portion to form each dot of said third ink is equal to a third value, when said image is formed on the recording medium with said predetermined resolution, with said predetermined gray-scale value at a picture element corresponding to said each dot of said third color.

16. The color ink-jet printer according to claim 15, wherein said third value is equal to one of said first and second values.

17. The color ink-jet printer according to claim 14, further comprising a print-mode memory portion operable to store said presently selected print mode indicative of one of first and second print qualities, said first print quality being lower than said second print quality, and wherein said second control portion controls said ink ejecting portion such that said second value is smaller than said first value if the presently selected print mode indicates said first print quality.

18. The color ink-jet printer according to claim 17, wherein said second control portion controls said second ink ejecting portion such that said second value is not smaller than said second value if the presently selected print mode indicates said second print quality.

19. The color ink-jet printer according to claim 14, wherein said first and second control portions control said first and second ink ejecting portions, to change said first value of the total volume of the at least one droplet of said first ink and said second value of the total volume of the at least one droplet of said second ink when said presently selected print mode is changed from said one mode to another, such that the changed second value is smaller than the changed first value.

20. The color ink-jet printer according to claim 14, wherein said first and second control portions control said first and second ink ejecting portions such that said second value for the total volume of the at least one droplet of said second ink is kept smaller than said first value of the total volume of the at least one droplet of said first ink, after said presently selected print mode is changed from one mode to another.

21. A color ink-jet printer comprising:

a first ink ejecting portion operable to eject droplets of a black ink;

a second ink ejecting portion operable to eject droplets of an ink of a color other than black;

a pulse-waveform-data memory for storing pulse-waveform data indicative of a plurality of different waveforms corresponding to respective different total volume values of at least one droplet of each of the black ink and the ink of said color other than black;

a first control portion operable to select, for said at least one droplet for forming each dot of said black ink on a recording medium, one of said plurality of different waveforms stored in said pulse-waveform-data memory, and control said first ink ejecting portion to eject said at least one droplet, on the basis of the selected one of said plurality of different waveforms; and a second control portion operable to select, for said at least one droplet for forming each dot of said color other than black on said recording medium, another of said plurality of different waveforms stored in said pulse-waveform-data memory, and control said second ink ejecting portion to eject said at least one droplet, on the basis of the selected another of said plurality of different waveforms, wherein a total volume of said at least one droplet of said black ink ejected by said first ejecting portion is larger than a total volume of said at least one droplet of the ink of said color other than black ejected by said second ink ejecting portion and said first and second control potions controlling said first and second ink ejecting portions such that a relationship between said total volume of the at least one droplet of said black ink and said total volume of the at least one droplet of the ink of said color other than black changes when a presently selected print mode of the color ink-jet printer is changed from one mode to another, wherein said first and second control portions are operable to select said one and another of said plurality of different waveforms, on the basis of said presently selected print mode that is selected from a plurality of different print modes which correspond to respective different values of resolution of an image to be printed on said recording medium, irrespective of gray-scale values at respective picture elements of said image.

22. The color ink-jet printer according to claim 21, further comprising a first pulse generator operable to generate a drive pulse signal to be applied to said first ink ejecting portion, on the basis of said one of said plurality of different waveforms selected by said first control portion, and a second pulse generator operable to generate a drive pulse signal to be applied to said second ink ejecting portion, on the basis of said another of said plurality of different waveforms selected by said second control portion.

23. The color ink-jet printer according to claim 21, wherein said first and second control portions are operable to select said one and another of said plurality of different waveforms, on the basis of respective gray-scale values at respective picture elements of an image at which respective ink dots are to be formed by said first and second ink ejecting portions according to print data.

24. The color ink-jet printer according to claim 21, further comprising a print-mode memory portion operable to store said presently selected print mode indicative of one of first and second print qualities, said first print quality being lower than said second print quality, and wherein said second control portion controls said second ink ejecting portion such that said total volume value of the at least one droplet of said color other than black is smaller than said total value of the at least one droplet of said black ink if the presently selected print mode indicates said first print quality.

25. The color ink-jet printer according to claim 24, wherein said second control portion controls said second ink ejecting portion such that said total volume of the at least of the at least one droplet of said color other than black is not smaller than said total volume of the at least one droplet of said black ink if the presently selected print mode indicates said second print quality.

26. The color ink-jet printer according to claim 21, wherein said first and second control portions control said first and second ink ejecting portions, to change said total volume of the at least one droplet of said black ink and said total volume of the at least one droplet of the ink of said color other than black when said presently selected print mode is changed from said one mode to another, such that the changed total volume of the at least one droplet of the ink of said color other than black is smaller than the changed total volume of the at least one droplet of said black ink.

27. The color ink-jet printer according to claim 21, wherein said first and second control portions control said first and second ink ejecting portions such that said total volume of the at least one droplet of the ink of said color other than black is kept smaller than said total volume of the at least one droplet of said black ink, after said presently selected print mode is changed from one mode to another.

28. A color ink-jet printer comprising:

a first ink ejecting portion operable to eject droplets of a black ink;

a second ink ejecting portion operable to eject droplets of an ink of a color other than black;

a first control portion operable to control said first ink ejecting portion such that a total volume of at least one droplet of said black ink ejected by said first ink ejecting portion to form each dot of the black ink on a recording medium is equal to a selected one of a plurality of different total volume values; and a second control portion operable to control said second ink ejecting portion such that a total volume of at least one droplet of the ink of said color other than black, which is ejected by said second ink ejecting portion to form each ink dot of said color other than black on the recording medium, is equal to another of said plurality of different total volume values which is smaller than said selected one total volume value, and wherein said first and second control portions control said first and second ink ejecting portions to form an image on the recording medium, such that a relationship between said selected one total volume value of the at least one droplet of said black ink and said another total volume value of the at least one droplet of the ink of said color other than black in each first local area of said image in which the black ink dots are adjacent to the ink dots of said color other than black is different from that in each second local area of the image in which the black ink dots are not adjacent to the ink dots of said color other than black.

29. The color ink-jet printer according to claim 28, wherein said first and second control portions control said first and second ink ejecting portions, to change said selected one total volume value of the at least one droplet of said black ink and said another total volume value of the at least one droplet of the ink of said color other than black in at least said each second local area of the image, when gray-scale values at picture elements corresponding to the ink dots in said each second local area of the image are changed.

30. A color ink-jet printer comprising:

a first ink ejecting portion operable to eject droplets of a first ink of a first color;

a second ink ejecting portion operable to eject droplets of a second ink of a second color other than said first color;

a first control portion operable to control said first ink ejecting portion such that a total volume of at least one droplet of said first ink ejected by said first ink ejecting portion to form each dot of said first ink on a recording medium is equal to a first value, when an image is formed on the recording medium with a predetermined resolution, with a predetermined gray-scale value at a picture element corresponding to said each dot of said first ink; and a second control portion operable to control said second ink ejecting portion such that a total volume of at least one droplet of said second ink ejected by said second ink ejecting portion to form each dot of said second ink on the recording medium, is equal to a second value smaller than said first value, when said image is formed on the recoding medium with said predetermined resolution, with said predetermined gray-scale value at a picture element corresponding to said each dot of said second ink, and wherein said first and second control portions control said first and second ink ejecting portions such that a relationship between said first value if the total volume of the at least one droplet of said first ink and said second value of the total volume of the at least one droplet of said second ink in each first local area of said image in which the dots of said first ink are adjacent to the dots of said second ink is different from that in each second local area of the image in which the dots of the first ink are not adjacent to the dots of the second ink.

31. The color ink-jet printer according to claim 30, wherein said first and second control portions control said first and second ink ejecting portions, to change said first value of the total volume of the at least one droplet of said first ink and said second value of the total volume of the at least one droplet of said second ink in at least said each second local area of the image, when the gray-scale values at the picture elements corresponding to the ink dots in each said local area of the image are changed.

32. A color ink-jet printer comprising:

a first ink ejecting portion operable to eject droplets of a black ink;

a second ink ejecting portion operable to eject droplets of an ink of a color other than black;

a pulse-waveform-data memory for storing pulse-waveform data indicative of a plurality of different waveforms corresponding to respective different total volume values of at least one droplet of each of the black ink and the ink of said color other than black;

a first control portion operable to select, for said at least one droplet for forming each dot of said black ink on a recording medium, one of said plurality of different waveforms stored in said pulse-waveform-data memory, and control said first ink ejecting portion to eject said at least one droplet, on the basis of the selected one of said plurality of different waveforms; and a second control portion operable to select, for said at least one droplet for forming each dot of said color other than black on said recording medium, another of said plurality of different waveforms stored in said pulse-waveform-data memory, and control said second ink ejecting portion to eject said at least one droplet, on the basis of the selected another of said plurality of different waveforms, wherein a total volume of said at least one droplet of said black ink ejected by said first ejecting portion is larger than a total volume of said at least one droplet of the ink of said color other than black ejected by said second ink ejecting portion, said first and second control portions controlling said first and second ink ejecting portions to form an image on the recording medium, such that a relationship between said total volume of the at least one droplet of said black ink and said total volume of the at least one droplet of the ink of said color other than black in each first local area of said image in which the black ink dots are adjacent to the ink dots of said color other than black is different from that in each second local area of the image in which the black ink dots are not adjacent to the ink dots of said color other than black.

33. The color ink-jet printer according to claim 32, wherein said first and second control portions control said first and second ink ejecting portions, to change said total volume of the at least one droplet of said black ink and said total volume of the at least one droplet of the ink of said color other than black in at least said each second local area of the image, when gray-scale values at picture elements corresponding to the ink dots in said each second local area of the image are changed.

* * * * *